US005632552A

United States Patent [19]

Wang et al.

[11] Patent Number: 5,632,552

[45] Date of Patent: May 27, 1997

[54] LAMP HOLDER HAVING LOCKABLE CAP WITH INTEGRAL CLAMPING ELEMENTS

[75] Inventors: Jessica Wang; Dennis Wang, both of Taipei, Taiwan

[73] Assignee: Toyo Electric Manufacturing Co. Ltd., Taipei, Taiwan

[21] Appl. No.: 633,123

[22] Filed: Apr. 16, 1996

[51] Int. Cl.[6] ..... F21V 21/00

[52] U.S. Cl. ..... 362/396

[58] Field of Search ..... 362/396

[56] References Cited

U.S. PATENT DOCUMENTS

| | | | |
|---|---|---|---|
| 1,895,656 | 1/1933 | Gadke | 362/396 |
| 1,980,948 | 11/1934 | Abramson . | |
| 2,331,877 | 11/1943 | Wellfield . | |
| 4,679,126 | 7/1987 | Van Sickler . | |
| 4,802,072 | 1/1989 | Cau . | |
| 4,803,396 | 2/1989 | Kelner . | |
| 4,841,420 | 6/1989 | Baggio . | |
| 5,184,890 | 2/1993 | Chen . | |
| 5,355,288 | 10/1994 | Maddock . | |
| 5,435,741 | 7/1995 | Wang . | |
| 5,481,444 | 1/1996 | Schultz . | |
| 5,542,636 | 8/1996 | Manh et al. | 362/396 |

*Primary Examiner*—Carroll B. Dority
*Attorney, Agent, or Firm*—Martin Smolowitz

[57] ABSTRACT

An improved lamp holder assembly includes an electrical bulb base member which has its lower end inserted into a cavity in a socket member, and is removably retained therein by an annular-shaped cap member removably locked onto the upper end of the socket member. the annular cap member has a radially extending u-shaped clamping element which includes dual arms integrally molded onto the cap member, together with an adjacent u-shaped wire guide element. The wire guide element can attach the socket member onto the lamp holder electrical wires, and the u-shaped clamping element can be used for attaching the lamp holder assembly onto a separate structure or surface, so as to form together with other lamp holder assemblies a decorative lighted structure such an animal or tree.

7 Claims, 2 Drawing Sheets

12
13
17
21
25
20a
16
16b
16c
16a
14b
16a
16a
24
14
15

LAMP HOLDER HAVING LOCKABLE CAP WITH INTEGRAL CLAMPING ELEMENTS

BACKGROUND OF INVENTION

This invention relates to an improved lamp holder assembly adapted for use in a series of spaced-apart decorative lights, such as Christmas lights, and includes a removable annular-shaped cap member which locks rotatably onto a socket member to positively retain an electrical bulb therein. The invention particularly relates to a lamp holder having a u-shaped fastener clamp integrally molded onto the lockable cap member for affixing the lamp holder to a desired support structure or surface. The lockable cap member also includes a wire guide potion located adjacent to the fastener clamping element, for receiving and positioning electrical wires leading to and from the lamp holder socket.

Many types of lamp holder assembly arrangements are disclosed by the prior art, however, they all exhibit various lamp deficiencies and shortcomings for convenient and reliable usage. For example, U.S. Pat. No. 4,802,072 to Kall discloses a lamp socket having a direction fixture integrally formed as part of the socket for retaining the electrical wires so as to orient the socket in the direction of a series of lamp sockets spaced along the wires. The socket direction fixture has an elastic access notch for retaining the wires, but no provision is made to affix the lamp holder to another structure. U.S. Pat. No. 5,355,288 to Maddock discloses a lamp holder which has an integral clip formed by a pair of spaced-apart radial jaws for attaching the lamp holder onto a structure such as screw head. Also, U.S. Pat. No. 5,435,741 to Wang discloses a bulb fastening structure for Christmas light strings, which includes an annular cap attached securely onto a socket by utilizing inner interlocking projections. Other prior art patents employ various conventional clips on a lamp socket body for positioning the lamp socket onto a structure such as a tree limb. However. none of the known prior art discloses a lamp holder assembly having the advantages and benefits as provided by the present invention.

SUMMARY OF INVENTION

The main object of the present invention is to provide an improved lamp holder assembly having a rotatably lockable annular cap member with integrally formed clamp and wire guide elements.

Another object of the invention is directed to providing a lamp holder having such a lockable cap member integrally molded as a unitary structure with a hold-down clamping element provided adjacent to a wire guide element.

A further object of the invention is to provide a lamp holder assembly which is easy to use and inexpensive, and has an integral clamping element for positively mounting the lamp holder onto an independent structure or surface so as to form a decorative pattern.

The lamp holder assembly according to the invention includes an electrical bulb having dual bare wires extending from its lower end and which is inserted into a cavity located in an upper portion of a base member. The base member is inserted into a cavity provided in the upper end portion of a socket member having two electrically insulated wires connected to its lower end. The base member is received in the socket member so that the wires provide electrical contact therein. The electrical bulb base member is retained in the socket member by an annular-shaped cap or collar member which is rotatable, lockable onto the socket member. The cap member has a u-shaped clamping portion integrally molded onto a cylindrical-shaped side of the cap member. Also, a u-shaped wire guide is integrally molded onto the socket member adjacent to the u-shaped clamping portion, so that the wire guide shares one leg of the u-shaped clamping portion of the cap member. The dual u-shaped arms of the clamping portion advantageously have multiple longitudinal serrations provided on their inner surfaces, which facilitate attaching the cap member of the lamp holder assembly together with other lamp holder assemblies onto a stationary structure or surface so as to provide a decorative patterns or shape, such as a recognizable animal, figure or tree.

This invention advantageously provides an improved decorative lamp holder assembly, which can be part of a string of decorative electrical lamps, with each lamp holder being conveniently and reliably attached onto a stationary structure such as a tree limb or a wire frame by utilizing the u-shaped clamping element which is integrally molded onto the side of the lamp holder cap member. These lamp holder assemblies can also each be oriented substantially parallel with the dual electrical wires, connected to the lamp holder. by the wires being retained in a wire guide element integrally molded onto the cap member adjacent to the u-shaped clamping elements.

BRIEF DESCRIPTION OF DRAWINGS

This invention will be described further as a preferred embodiment with reference to the accompanying drawings, in which.

DESCRIPTION OF INVENTION

Figure 1:
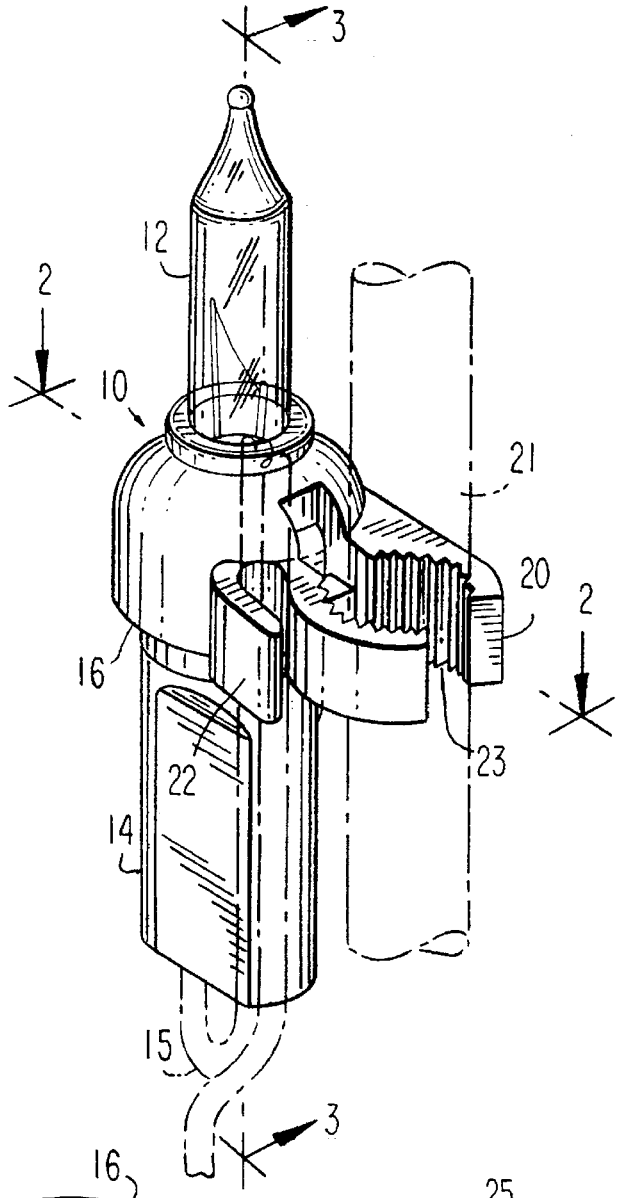
FIG. 1 is a perspective side view of the lamp holder assembly of the present invention shown as one of a series of electrically connected decorative lamps, with the lamp holder collar clamping member affixed to an independent support structure and the wire guide element holding two electrical wires.

The present invention is directed to providing an improvement for decorative lamp holders of the general type disclosed by U.S. Pat. No. 5,435,741, the disclosure of which is incorporated herein by reference to the extent needed to adequately disclose the present invention. More particularly, as shown in the accompanying FIGS. 1–3, the lamp holder assembly 10 comprises an electrical bulb element 12, which is inserted into a base element 13 which has dual bare electrical wires 13*a* extending out from its lower end. The bulb base element 13 is inserted into a complementary-shaped cavity 14*a* provided in the upper end of a socket member 14, in such manner that the dual bare wires 13*a* each contact one of dual electrically insulated wires 15 which extend from the lower end of socket member 14.

The bulb base element 13 inserted into the socket 14 is positively held in position by an annular-shaped cap 16. The cap 16 is detachably locked onto the upper end of the socket 14 by having dual radial projections 14*b* provided at the socket upper end, which projections can slide into dual interfitting longitudinal grooves 16*a* provided in the inner surface of the cap 16 and then be rotated past a cam surface 16*b* into adjacent dual lock recesses 16*c* of the cap 16. The dual lock recesses 16*c* communicate with dual openings 17 provided in the cylindrical-shaped wall of the cap 16.

Figure 2:
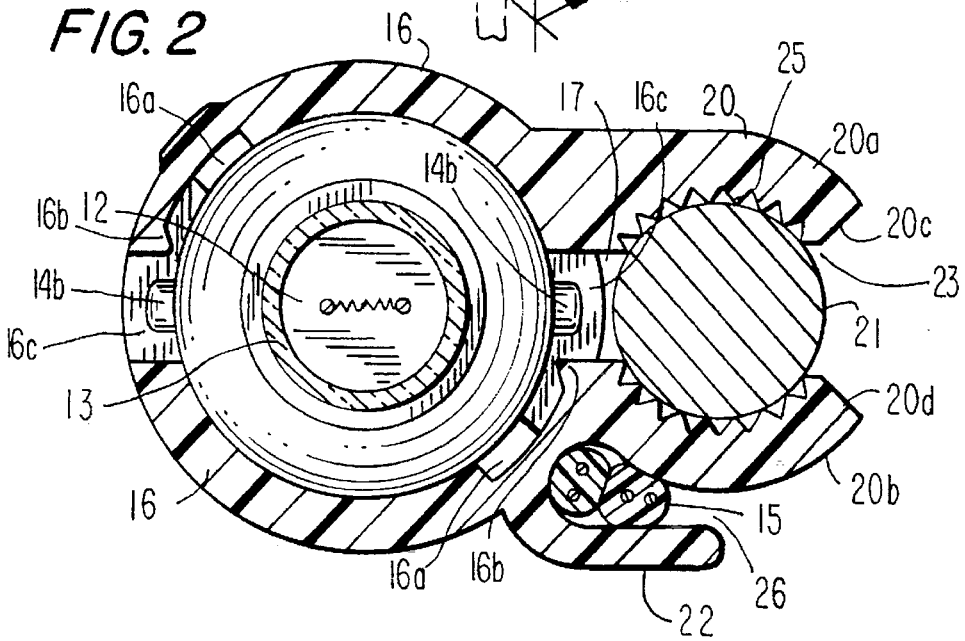
FIG. 2 is a sectional plan view taken at line 2—2 of FIG. 1.
Figure 3:
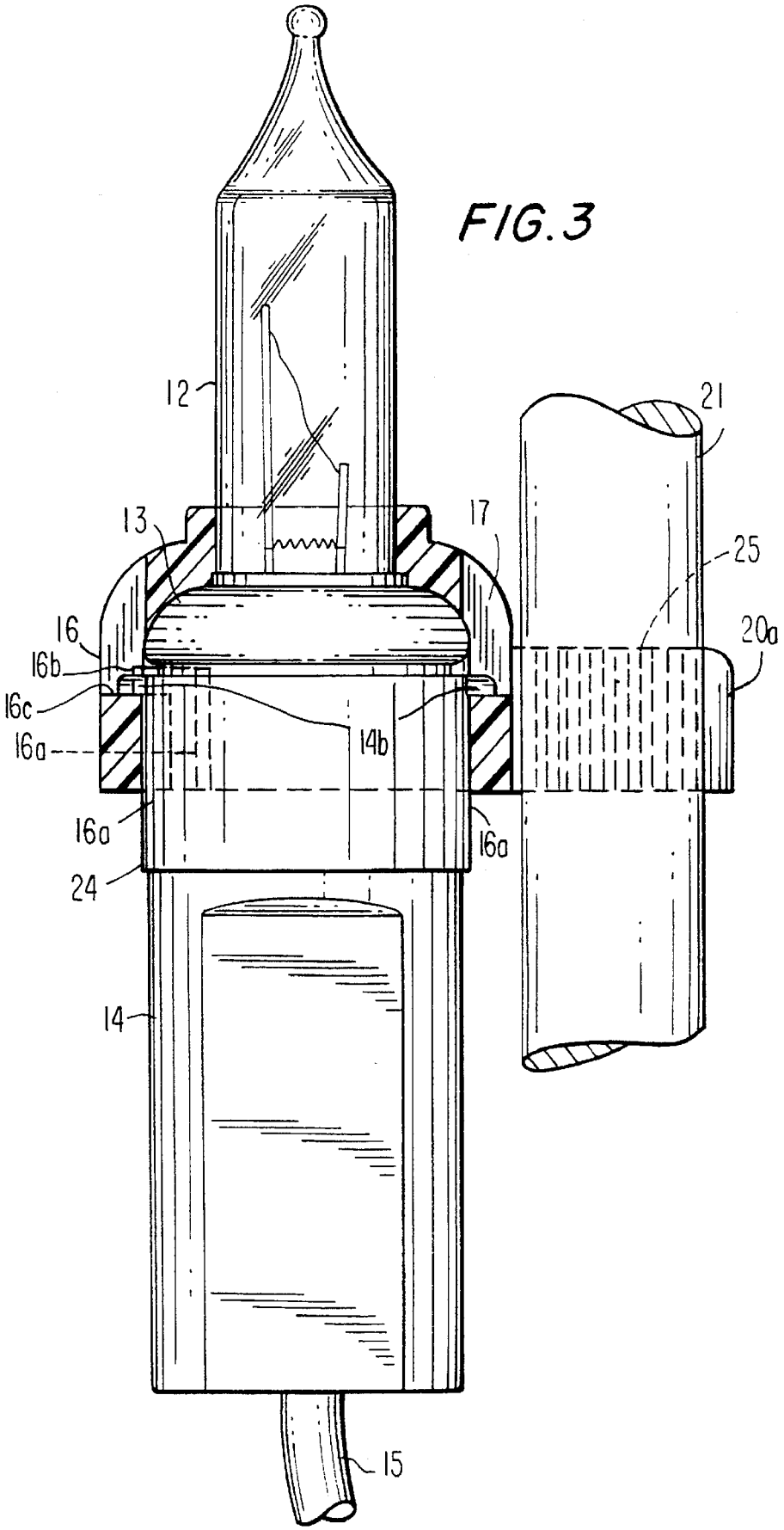
FIG. 3 is a partial sectional elevational view taken at line 3—3 of FIG. 1, and showing the lamp holder assembly clamped onto an independent support structure.

The annular cap 16 is advantageously provided with an integrally molded clamping or holding element 20 which is adapted for securing the lamp holder assembly 10 to a convenient support structure or surface 21, such as shown in FIGS. 1–3. The cap member 16 is additionally provided with a u-shaped wire guide element 22*c* integrally formed in the cap side wall and disposed in close proximity to the clamping element 20. The entire cap member 16, including the clamping element 20 and wire guide element 22, is of a unitary construction (see FIG. 2) and is formed of a suitable resilient moldable plastic material such as polyethylene or polypropylene.

The clamping element 20 of the detachable annular cap or collar 16 is generally made u-shaped as defined by a pair of curved spaced apart gripping jaw members 20*a*, 20*b*, each being disposed substantially perpendicular to and in alignment with the lower portion of cap 16. Each of the spaced-apart gripping members 20*a*, 20*b*, is formed with angular receiving surfaces 20*c*, 20*d* to define the u-shaped opening 23 which permits easy entry and positioning for engagement of the lamp holder assembly 10 onto a suitable structure or surface 21 as generally shown in FIG. 2.

The annular cap 16 has a wire guide element 22 which is also integrally molded in the cap wall adjacent to the clamping jaw 20*b*. The wire guide element 22 is formed as an arcuate projection extending perpendicular to the cap 16 wall and in alignment with the bottom surface 24 thereof, so as to define a space 26 formed between the outer surface of gripping jaw element 20*b* and the spaced wire guide element 22. The element 22 is shaped inwardly toward the adjacent surface 20*b* so as to form an oblique space or opening 23 for positively receiving and retaining the electrical wires 15 of lamp holder 10. The opening 23 is made narrow at its entrance and gradually expands to permit entry and retention by engagement of wires 15 with the parallel wall surfaces of cap 16 and gripping jaw element 20*b*. The inner surfaces of gripping jaw elements 20*a*, 20*b* are each provided with multiple parallel serrations 25 to form a plurality of engagement surfaces for co-action with the independent structure or surfaces 21 upon which the lamp holder 10 is to be held in place.

The present invention is particularly suited for lamp holders for a series of decorative lamps, such as Christmas ornamental lamps, which are to be affixed onto a structure or surface 21 in order to conform to a predefined pattern. For example, the decorative lamps can be positioned on a wire frame shape of a particular recognizable structure, such as a reindeer, a Santa Claus figure, or sleigh so as to add a lighted feature to such a structure or figures. In such an arrangement, the lamp holders are each affixed by engagement of the cap clamping members 20 to the structure such as a wire frame by action of the gripping elements 20*a*, 20*b*, with the surface of the wire frame, so as to provide a clamping action therewith. In sequence, the bulb 12, socket 14 and associated wires 15 are spaced therefrom, so as to assure that the lamp holders 10 each have a fixed relationship with each other and are free from any unwanted interference with the structure or surface upon which the lamp holder is mounted.

Although this invention has been described broadly and also in terms of a preferred embodiment, it will be apparent that modifications and variations can be made and that some elements can be provided without others, all within the scope as defined by the appended claims.

I claim:

1. A lamp holder assembly adapted for attachment onto an independent structure for providing a decorative light display, comprising:

an electrical bulb element inserted into a base member and having two bare electrical wires extending from the base member lower end;

a socket member having a cylindrical-shaped cavity formed in its upper portion and sized for receiving the base member lower end; the socket member having two electrically insulated wires extending from its lower end; and an annular-shaped cap member adapted for encircling bulb element and the base member and being interfitted onto the upper end of said socket member, said cap member including a u-shaped clamping element extending radially outwardly from the cap member and adapted for mounting the lamp holder securely onto an independent structure.

2. The lamp holder of claim 1, wherein said cap member includes a u-shaped wire guide element located adjacent to the u-shaped clamping element.

3. The lamp holder of claim 1, wherein said clamping element inner surface has multiple parallel serration for providing increased frictional contact with the independent structure.

4. The lamp holder of claim 1, wherein said socket member has dual radial projections which interfit with dual longitudinal grooves and dual recesses provided in said annular cap, whereby the annular cap member is removably locked onto the socket member.

5. The lamp holder assembly of claim 1, wherein said cap clamping element is attached onto an independent structure.

6. The lamp holder assembly of claim 2, wherein said wire guide element is clamped around two electrical wires extending from the lower end of said socket member.

7. A lamp holder assembly adapted for attachment onto an independent structure for providing a decorative lighted display, comprising:

(a) an electrical bulb element inserted into a base member and having two bare electric wires extending from the base member lower end;

(b) a socket member having a cylindrical-shaped cavity formed in its upper portion and sized for receiving the base member lower end therein, said socket member having two electrically-insulated wires extending from its lower end and having dual radial projections provided at its upper end;

(c) an annular-shaped cap member adapted for encircling the bulb dement and base member and being interfitted onto the upper end of said socket member, said cap member including a u-shaped clamping element extending radially outwardly from the cap member lower end and adapted for mounting the lamp holder securely onto an independent structure; and (d) a u-shaped wire guide element located adjacent the u-shaped clamping element, wherein said socket member dual radial projections interfit with the dual longitudinal grooves and dual recesses provided in said annular cap, whereby the cap is removably locked onto the socket member.

* * * * *